US010689215B2

(12) United States Patent
Maeshima

(10) Patent No.: US 10,689,215 B2
(45) Date of Patent: Jun. 23, 2020

(54) AUTOMATIC CLOTH FEEDER

(71) Applicant: TOTOFOLDER MANUFACTURING CO., LTD., Kawaguchi-shi, Saitama (JP)

(72) Inventor: Yusuke Maeshima, Kawaguchi (JP)

(73) Assignee: TOTOFOLDER MANUFACTURING CO., LTD., Kawaguchi-Shi, Saitama (JP)

( * ) Notice: Subject to any disclaimer, the term of this patent is extended or adjusted under 35 U.S.C. 154(b) by 438 days.

(21) Appl. No.: 15/575,403

(22) PCT Filed: May 29, 2015

(86) PCT No.: PCT/JP2015/065626

§ 371 (c)(1),
(2) Date: Nov. 20, 2017

(87) PCT Pub. No.: WO2016/194064

PCT Pub. Date: Dec. 8, 2016

(65) Prior Publication Data

US 2018/0148287 A1 May 31, 2018

(51) Int. Cl.

| | |
|---|---|
| ***B65H 7/02*** | (2006.01) |
| ***D06F 67/04*** | (2006.01) |
| ***D06F 87/00*** | (2006.01) |
| ***B65H 5/02*** | (2006.01) |

(Continued)

(52) U.S. Cl.
CPC ..... *B65H 7/02* (2013.01); *B65H 5/025* (2013.01); *B65H 5/085* (2013.01); *D06F 67/04* (2013.01);

(Continued)

(58) Field of Classification Search
CPC ..... B65H 7/02; B65H 5/025; B65H 5/085; B65H 2301/44312; B65H 2301/453;

(Continued)

(56) References Cited

U.S. PATENT DOCUMENTS 5,016,529 A * 5/1991 Jahn ..... B41F 7/06 101/183
5,168,645 A * 12/1992 Robin ..... D06F 95/00 38/143

(Continued)

FOREIGN PATENT DOCUMENTS

| | | |
|---|---|---|
| JP | 10-24200 | 1/1998 |
| JP | 11-114296 | 4/1999 |

(Continued)

OTHER PUBLICATIONS

International Search Report dated Aug. 11, 2015.

*Primary Examiner* — Ismael Izaguirre
(74) *Attorney, Agent, or Firm* — Jacobson Holman, PLLC

(57) ABSTRACT

In an automatic cloth feeder that conveys cloth with a feeding conveyor, detects a trailing end of the cloth to hold the trailing end with a keeping-transferring part in the process of conveyance, and feeds the trailing end of the cloth into a process as a leading end, the keeping-transferring part has a pair of unfolding members provided as one set are provided on an outlet side of the feeding conveyor in order to hold the left and right trailing ends of the cloth, and the keeping-transferring part has holding pieces that are opened and closed substantially to the right and the left as seen from the top or from the front, to hold the trailing ends of the cloth but not coming into contact with the lifting means, in an open state and that is at the position of the lifting means in a closed state.

4 Claims, 11 Drawing Sheets

(51) Int. Cl.
*B65H 5/08* (2006.01)

(52) U.S. Cl.
CPC .... *D06F 87/00* (2013.01); *B65H 2301/44312* (2013.01); *B65H 2301/453* (2013.01); *B65H 2701/174* (2013.01)

(58) Field of Classification Search
CPC ... B65H 2701/174; D06F 67/04; D06F 87/00; B65G 47/36; B65G 47/90
See application file for complete search history.

(56) References Cited

U.S. PATENT DOCUMENTS 5,169,282 A * 12/1992 Ueda ..... D06F 67/04 38/7
5,515,627 A * 5/1996 McCabe ..... D06F 67/04 38/143
5,606,811 A * 3/1997 Jensen ..... D06F 67/04 38/143
5,611,159 A * 3/1997 Jensen ..... D06F 67/04 38/143
5,876,320 A * 3/1999 LeCompte ..... B65H 45/12 493/125
6,854,711 B2 * 2/2005 Krause ..... B29C 45/0017 137/15.25

FOREIGN PATENT DOCUMENTS

| | | |
|---|---|---|
| JP | 11-128596 | 5/1999 |
| JP | 2000-70600 | 3/2000 |
| JP | 2005-87321 | 4/2005 |
| JP | 2005-218553 | 8/2005 |

* cited by examiner

AUTOMATIC CLOTH FEEDER

TECHNICAL FIELD

The present invention relates to an automatic cloth feeder that conveys cloth with a feeding conveyor, detects a trailing end of cloth to hold the trailing end with a keeping-transferring part in the process of conveyance, and feeds the trailing end of the cloth into a process as a leading end.

BACKGROUND ART

As linen goods to be treated in the so-called linen supply service, for example, there are sheets, bedcovers, other various kinds of cloth, such as large and small towels, and clothing, such as gowns. Makers repeat the work of collecting, washing, and ironing these kinds of cloth from customers, and the transferring the cloth to the customers through a folding process. Cloth is fed into a process by a feeder. However, in an automated feeding process, if cloth is placed on a feeding conveyor, a specific portion is held by a member on a feeder side during conveyance, automatic unfolding is performed, and the unfolded cloth is fed onto a conveying conveyor from its leading end. Therefore, cloth can be brought into an unfolded state, and can be conveyed to, for example, an ironing process.

The automatic feeding method falls roughly into two kinds of methods. One method is a method of searching for one end or both ends of cloth and feeding the cloth, and the other method is a method of feeding one side of cloth into a conveying conveyor and searching for and automatically unfolding both ends of the cloth. The current mainstream is the former method, and the reason is because the stability and the quality in the latter method are low. However, according to the present inventor's researches, the former method is not necessarily absolutely advantageous, the latter method rather has room for improvement, and the prospect of excelling the former method through improvement is obtained. In addition, the latter method includes the invention of JP-A-10-5500.

By adopting the automatic feeding method, the operation efficiency per one worker can be improved, the amount of output per one feeding station can be increased, and the maximum capacity of a shaping part that brings cloth into a shaped state can be exhibited through feeding using a plurality of stations. In contrast, the balance between the amounts of supply from the feeding stations is not maintained, and the delay of feeding work becomes a problem. Although it is desirable to be able to increase the number of pieces of cloth that can be accumulated from the feeding station to the shaping part, there is no such margin with the present apparatuses. On the contrary, if the processes of respective parts that convey cloth and detect, unfold, and feed a trailing end are performed with reliability and at high speed, the total amount of treatment should also be able to be increased, and even if the cloth movement distances per one station (distances at which cloth is accumulated) are the same, the number of pieces of cloth that can be buffered should be able to be increased, and feeding work should be able to become smoother.

CITATION LIST

JP-A-10-5500

SUMMARY OF INVENTION

The invention has been made in view of the above actual circumstances, and an object thereof is to increase the total amount of treatment by realizing reliability and high speed through processes of respective parts that convey cloth, and detect, unfold, and feed a trailing end of the cloth.

Additionally, another object of the invention is to provide an automatic cloth feeder capable of realizing size reduction and high efficiency by increasing the number of pieces of cloth that can be buffered even if the cloth movement distances per one station (equal to distances at which the cloth is accumulated) are the same, as an automatic cloth feeder equipped with a buffering function.

In order to solve the problems described above, in an automatic cloth feeder according to the present invention that conveys cloth with a feeding conveyor, detects a trailing end of the cloth to hold the trailing end with a keeping-transferring part in the process of conveyance, and feeds the trailing end of the cloth into a process as a leading end, the keeping-transferring part having a pair of unfolding members provided as one set are provided on an outlet side of the feeding conveyor in order to hold the left and right trailing ends of the cloth. The keeping-transferring part has holding pieces that are opened and closed substantially to the right and the left as seen from the top or from the front, is in a positional relationship of approaching lifting means but not coming into contact with the lifting means in an open state, and is configured so as to hold the trailing ends of the cloth located at the position of the lifting means in a closed state. In addition, the central portion of the cloth means left and right central portions in a movement direction during conveyance of the cloth to be conveyed (refer to FIGS. 5 and 9). Additionally, in the apparatus of the invention, cloth is targeted. However, clothing is included in the cloth.

The automatic cloth feeder to which the buffering device related to the invention is applied takes the aforementioned method of feeding one side of the cloth into the conveying conveyor and searching for and automatically unfolding both, ends of the cloth. When the cloth is introducing into the feeding conveyor at the substantially central portion in the conveying direction and is conveying to a predetermined position of a front surface of a feeder body, both the left and the right side portions of the cloth are narrowed in the direction of the central portion of the cloth, and keeping and transferring are performed at the left and right trailing ends of the cloth. By introducing the cloth into the feeding conveyor at the substantially central portion and conveying the cloth to the predetermined position of the front surface of the feeder body, both the left and the right side portions of the cloth that hang down to the left and right of the feeding conveyor are narrowed (brought closer) in the direction of the central portion of the cloth, and the loft and right trailing ends are made to be held by the members provided on the feeder side.

In such a configuration, in the invention, a keeping-transferring part having unfolding members that hold the left and right trailing ends of the cloth is provided on an outlet side of the feeding conveyor, the keeping-transferring part has holding pieces that are opened and closed substantially to the right and the left as seen from the top or from the front, is in a positional relationship of approaching lifting means but not coming into contact with the lifting means in an open state, and is configured so as to hold the trailing ends of the cloth that is at the position of the lifting means in a closed state. That is, in the open state of the holding pieces, the holding pieces are in the positional relationship of approaching the lifting means but not coming into contact with the lifting means. Thus, each of the unfolding members can travel at any time for unfolding without worrying about the interference with the lifting means unlike the related art, and improvement in work speed is possible.

As the automatic cloth feeder that conveys same cloth with a feeding conveyor, detects a trailing end of the cloth to hold the trailing end with a keeping-transferring part in the process of conveyance, and feeds the trailing end of the cloth into a process as a leading end, the automatic cloth feeder includes a trailing end separating member that extends with a given length substantially parallel to a movement direction of a clamp and has a space between a tip thereof and the clamp. The trailing end separating member is configured so as to operate to flap the cloth that hangs down from a feed port of the feeding conveyor. By virtue of this configuration, the cloth to be conveyed is supported at the central portion, and an action just like flapping is received by the central portion. Thus, the action of separating the trailing ends of the cloth to left and right is promoted.

In addition, it is desirable that the feeding conveyor includes a lower conveyor and an upper conveyor, is high at an intermediate portion and falls on an inlet side and an outlet side, is formed in a gentle chevron shape as a whole, and is thereby designed so as to convey cloth naturally, and that the delivery port of the feeding conveyor is directed to between a pair of rollers, and a feed guide part is arranged in the same direction in the lower conveyor. The cloth is delivered from the feeding conveyor, and is easily introduced between the next pair of rolls. As a result, even if a difference is in the properties of cloth, such as the hardness and softness of cloth and the strength and weakness of a waist, the stable processing of cloth is possible.

In an automatic cloth feeder according to the present invention that conveys cloth with a feeding conveyor, detects a trailing end of the cloth to hold the trailing end with a keeping-transferring part in the process of conveyance, and has a buffering function of causing the cloth to stand by temporarily when the trailing end of the cloth is fed into a processes as a leading end, the keeping-transferring part having a pair of unfolding members provided as one set are provided on an outlet side of the feeding conveyor in order to hold the left and right trailing ends of the cloth. The keeping-transferring part has holding pieces that are opened and closed substantially to the right and the left as seen from the top or from the front, and is in a positional relationship of approaching lifting means but not coming into contact with the lifting means in an open state and of holding the trailing ends of the cloth located at the position of the lifting means in a closed state. A traveling track X of the unfolding members does not interfere with a line Y that connects the lifting means, thereby providing a buffering function of enabling the unfolding members to travel and move at any time.

Since the unfolding members are able to travel and move at any time, even if the cloth movement distances per one station (equal to distances at which the cloth is accumulated) are the same, feeding work can be more smoothly performed by increasing the number of pieces of cloth that can be buffered.

Advantageous Effects of Invention

Since the invention is configured and functions as described above, an effect is exhibited in which the total amount of treatment can be increased by realizing reliability and high speed through processes of respective parts that convey cloth, and detect, unfold, and feed a trailing end of the cloth. Additionally, according to the invention, it is possible to provide the automatic cloth feeder capable of realizing size reduction and high efficiency by increasing the number of pieces of cloth that can be buffered even if the cloth movement distances per one station (equal to distances at which the cloth is accumulated) are the same, as an automatic cloth feeder equipped with a buffering function.

BRIEF DESCRIPTION OF DRAWINGS

FIG. 8 consists of FIGS. 8A, 8B and 8C and illustrates a cloth feeding process.

DETAILED DESCRIPTION OF THE INVENTION

Figure 1:
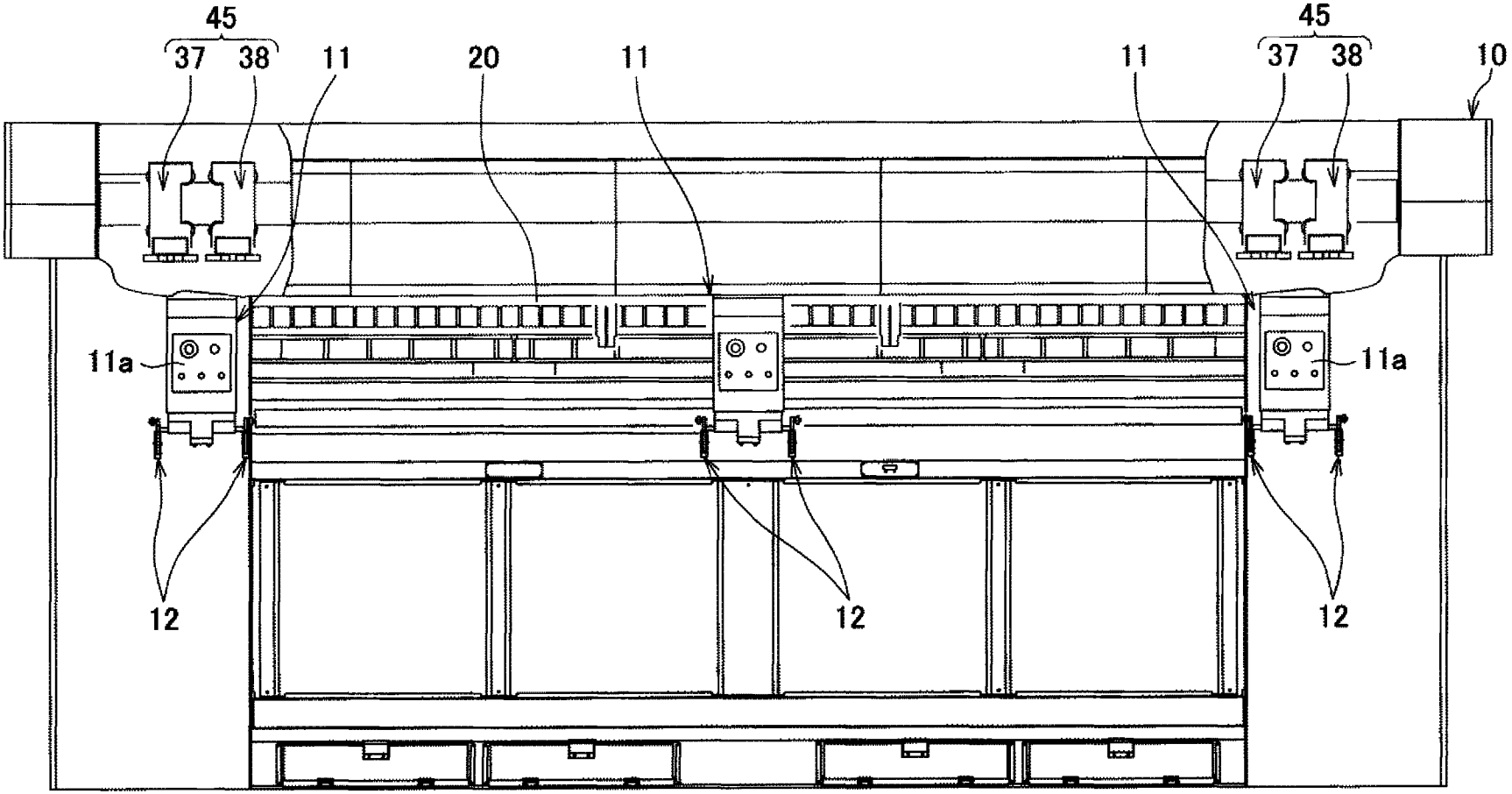
FIG. 1 is a front view illustrating an example of an automatic cloth feeder related to the invention, and the feeder includes a buffering function.
Figure 2:
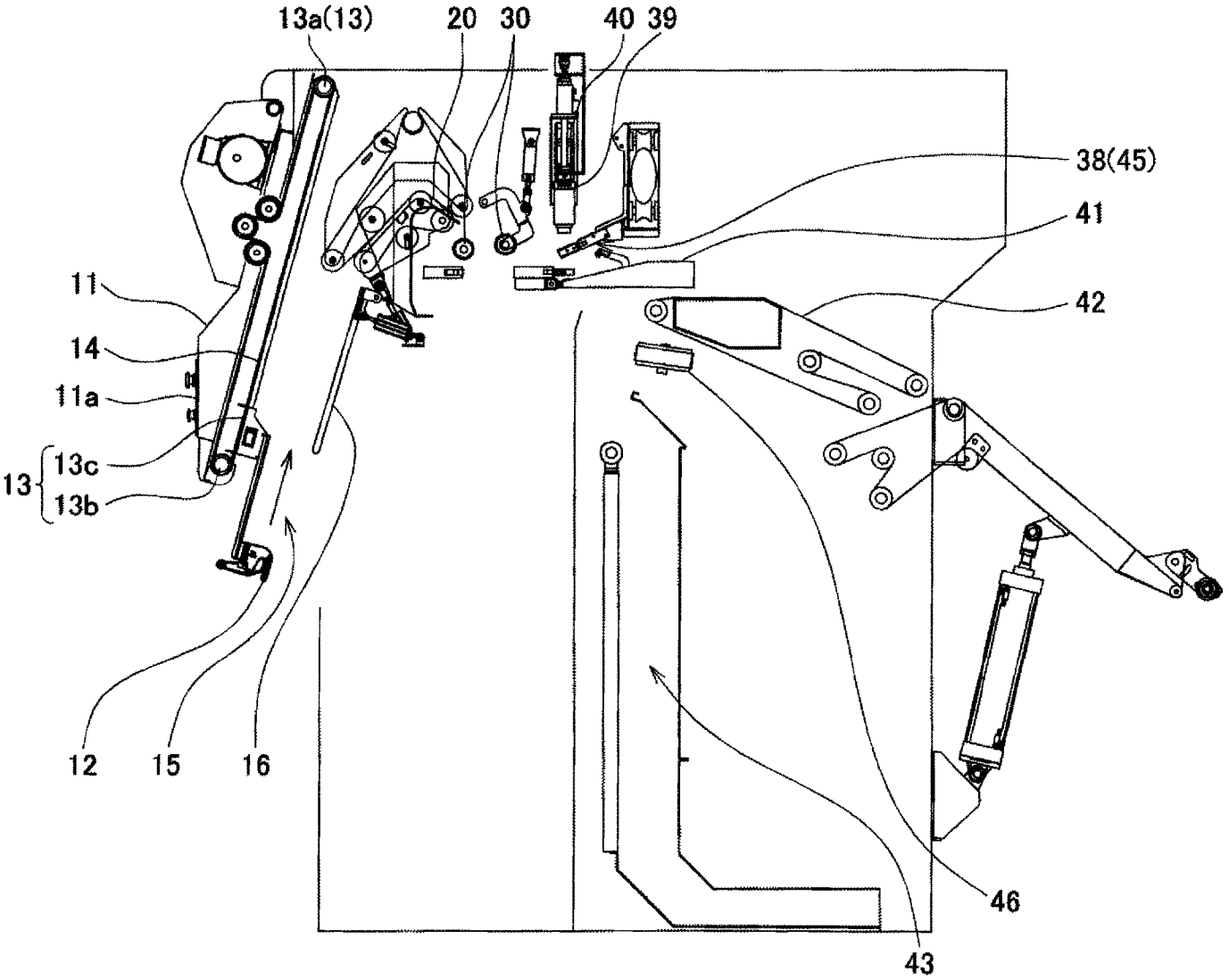
FIG. 2 is a side view illustrating the above automatic cloth feeder.

Hereinafter, the invention will be described in more detail with reference to the illustrated embodiment. FIGS. 1 and 2 illustrates an overall automatic cloth feeder 10 to which a buffering device related to the invention is applied. In this automatic cloth feeder, a cloth supply part 11, which is equipped with a clamp 12 that holds cloth at a substantially central portion in a movement direction when the cloth is introduced, moves toward an upper feeding conveyor 20 from below, and is arranged at a position equivalent to a front surface of a feeder body and a front portion of the feeding conveyor 20.

The cloth supply parts 11 are respectively arranged in a total of three places of the center and both left and right ends of the front surface of the feeder body in the apparatus of the embodiment, and moving mechanisms 13 are respectively provided in the cloth supply parts, FIG. 2. The illustrated moving mechanism 13 has a belt 13C wound around and stretched between upper and lower rollers 13*a* and 13*b*, is equipped with a pair of left and right clamps 12 and 12, and constitutes the cloth supply part 11 as a whole. Each clamp 12 is attached to the belt 13*c* via an arm 12*a* and a clamp attachment 12*b*, and is moved to ascend and descend between a lower position where the clamp is easily attached near a worker and an upper position above a feed port 20*a* of the feeding conveyor 20.

The cloth is held at substantially central portions in the movement direction by the pair of left and right clamps 12 and 12. Each clamp 12 may be a well-known clamp that pinches the cloth, and moves from the lower position near a worker to the upper position near the upper feeding conveyor 20 by virtue of the above movement configuration, refer to FIGS. 2 and 3. The cloth is attached to the pair of left and right clamps 12 and 12 by a worker. In addition, the portion of the cloth between the pair of clamps are made as horizontal as possible or as linear as possible. Additionally, the moving mechanism 13 can be configured such that the clamps 12 move from the lower position to the upper position as a portion of movement in which the clamp circles around a given path without repeating lifting and lowering. In that case, the amount of standby cloth can be increased and decreased according to a circling path length.

The above clamps 12 and the moving mechanism 13 thereof constitute the cloth supply part 11 that holds the cloth at the substantially central portions on the left and right in the movement direction and that is equipped with the clamps 12 that move to the upper feeding conveyor 20 from below. Additionally, in this embodiment, the cloth supply part 11 constitutes a cloth standby part 14 that causes the cloth to be conveyed to stand by temporarily. Particularly, this cloth standby part 14 corresponds to the cloth standby part 14 arranged at a preceding stage of the feeding conveyor 20.

Figure 3:
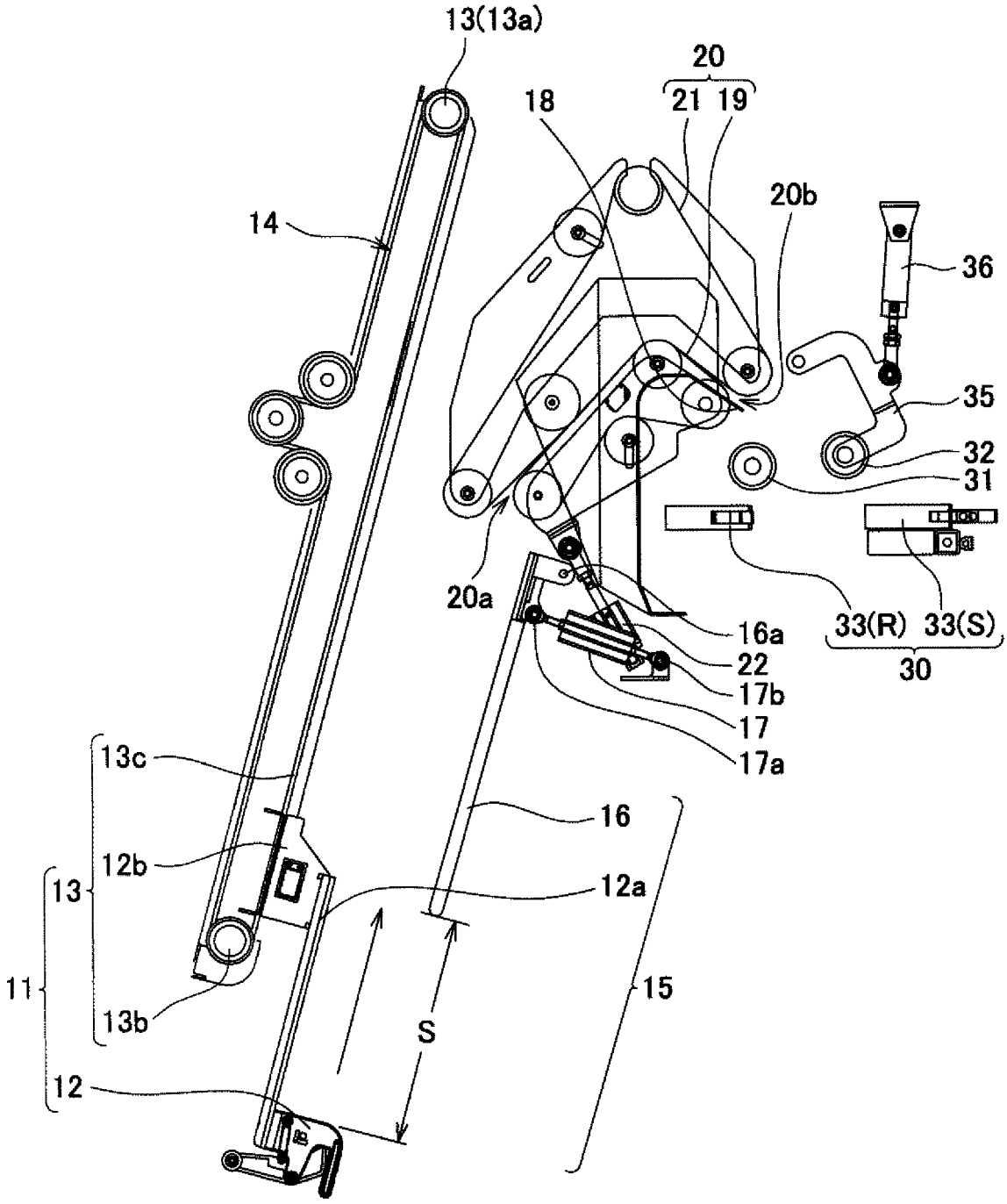
FIG. 3 is an enlarged side view illustrating main parts from a cloth supply part to a feeding conveyor.

A trailing end separating mechanism 15 for the cloth is provided parallel to the above cloth supply part 11. The trailing end separating mechanism 15, as illustrated in FIG. 3, has a trailing end separating member 16 that is rotatably journalled to a supporting shaft 16*a* on a body side. Although the trailing end separating member 16 extends by a given length substantially parallel to the movement direction of the clamps 12, a space S according to the length of the clamp attachment 12*a* or the trailing end separating member 16 is provided between the tip thereof and the above clamps 12. Therefore, the cloth can hang down to the space S.

A drive part 17 is journalled to one end 17*a* on a pivot side of the trailing end separating member 16, and the other end 17*b* of the drive part 17 is rotatably journalled to the body side.

Additionally, by virtue of this configuration, the trailing end separating member 16 is made rotatable toward the clamp attachment 12*a* or the cloth standby part 14. In addition, the trailing end separating mechanism 15 is configured so as to be able to ascend at a timing at which a trailing end of the cloth is separated, and descend to a position that becomes substantially parallel to the movement track of the clamps 12 during conveyance. Reference numeral 11*a* represents an operating part.

In the illustrated feeder body, the feeding conveyor 20 is arranged at an upper portion of the trailing end separating mechanism 15, and the feeding conveyor 20 includes a lower conveyor 19 and an upper conveyor 21. The above feeding conveyor 20 takes an arrangement orthogonal to the front of the feeder body, and three feeding conveyors are respectively arranged in a total of three places behind the cloth supply part 11, FIGS. 1 and 2. Since the feeding conveyor 20 has a form that is short in the cloth movement direction as mentioned above, there is a tendency in which a trailing end of the cloth is not easily separated left and right as compared with a conveyor that is long in the movement direction. In contrast, the trailing end separating mechanism 15 compensates for this tendency, and contributes to overall size reduction.

The lower conveyor 19 is supported upward by a drive part 22 including a cylinder device as a whole, and has a structure in which the pressure of contact with the upper conveyors 21 can be adjusted. The feeding conveyor 20 has the feed port 20*a* that is obliquely and downwardly directed substantially in conformity with the track of the moving mechanism 13, and is provided so that the cloth being moved by the clamps 12 can be fed reasonably.

Although the upper conveyor 21 includes a belt conveyor and is obliquely arranged so as to be low on a side near the feed port 20*a* and slightly high on a delivery port 20*b* side opposite to the above side as a whole, FIG. 3 the delivery port 20*b* is obliquely directed downward from above.

Figure 4:
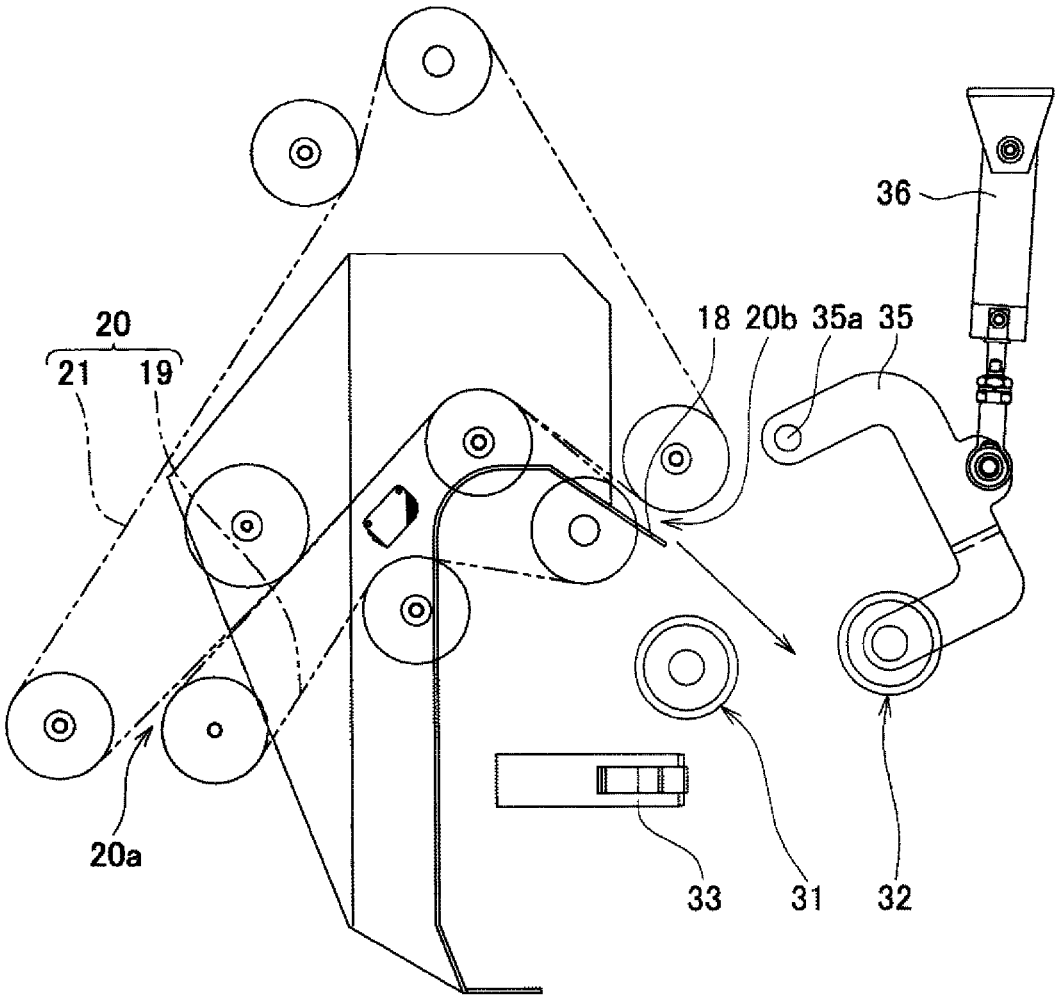
FIG. 4 is an enlarged side view illustrating a feeding conveyor section.

Therefore, the lower conveyor 19 is high at an intermediate portion and falls on an inlet side and an outlet side, is formed in a substantially inverted V-shape as a whole, and is thereby designed so as to convey the cloth naturally. The delivery port 20*b* of the feeding conveyor 20 is directed to between a pair of rollers 33 and 33 to be described below, and a feed guide part 18 is arranged in the same direction in the lower conveyor 19 (FIG. 4). The feed guide part 18 is located within the lower conveyor, and a tip thereof protrudes toward between the pair of rollers 33 and 33.

Figure 5:
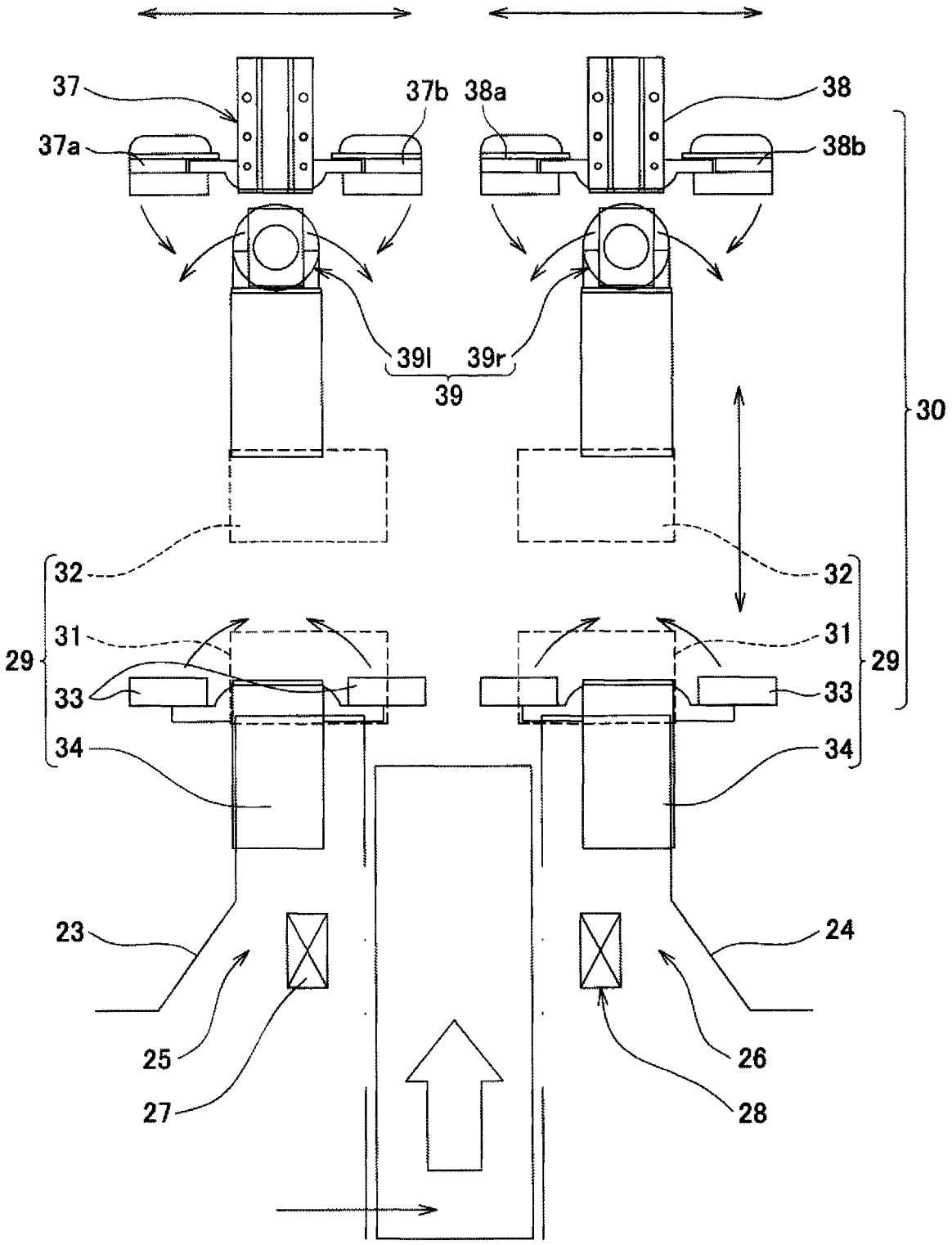
FIG. 5 is an enlarged plan view illustrating a keeping-transferring part.

Guide members 23 and 24 provided in a tapered shape are arranged on both left and right sides of the feeding conveyor 20 in order to bring both left and right side portions of the cloth, which hang down to the left and right of the feeding conveyor, closer to the central portions of the cloth, FIG. 5, and narrow the cloth. Therefore, the narrowed passages 25 and 26 are formed on the left and right of the feeding conveyor 20 such that both the left and the right side portions that fall on both the left and the right sides from the central portion of the cloth enter the narrowed passages and are narrowed. A pair of left and right sensors 27 and 28 that confirm arrival of left and right trailing ends, Wl and Wr in FIG. 8, of the cloth are arranged on tip sides of the narrowed passages 25 and 26, and a pair of catch means 29 are provided on each of the left and right of the narrowed passages in order to catch the above trailing ends (FIG. 5) at the tips thereof.

Figure 7:
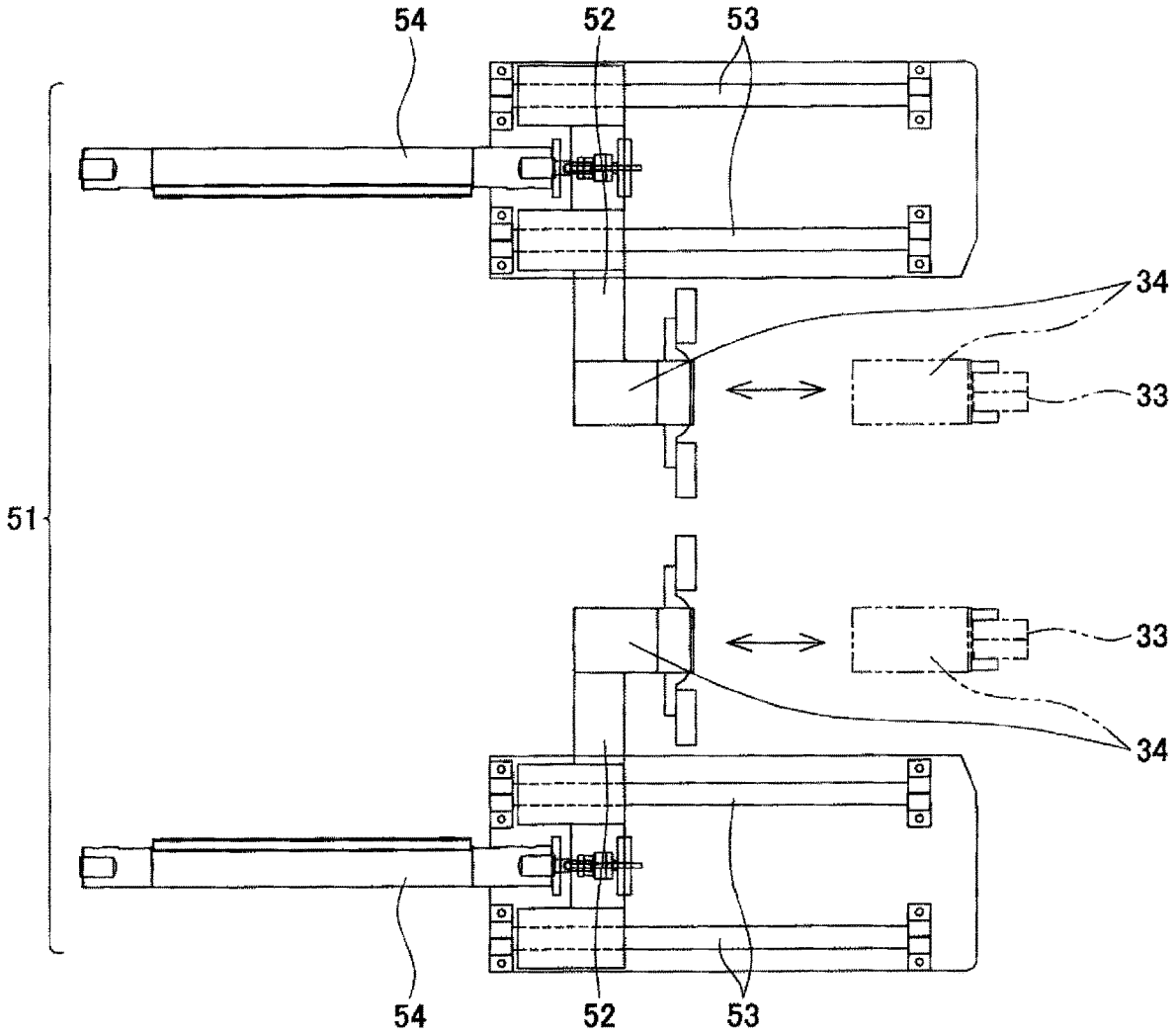
FIG. 7 is a plan view of a moving mechanism of a catch member.

Each catch means 29 includes a pair of front and rear rollers 31 and 32 that are provided so as to be capable of being brought into contact with or separated from each other in order to pinch the trailing ends Wl and Wr of the cloth, and a catch member 33 that operates in the direction of an arrow in an illustrated open state to a closed state in order to pinch the cloth when the left and right trailing ends of the cloth has come between the pair of rollers. The catch member 33 is opened and closed by a drive part 34, and is provided so as to be movable in a frontward-rearward direction by a moving mechanism 51 illustrated in FIG. 7. The moving mechanism 51 is constituted of a slider 52 having an arm that holds the drive part 34, a guide rail 53, and a cylinder of a drive part 54, and the moving mechanisms are installed on the left and right of the feeding conveyor 20.

Figure 6:
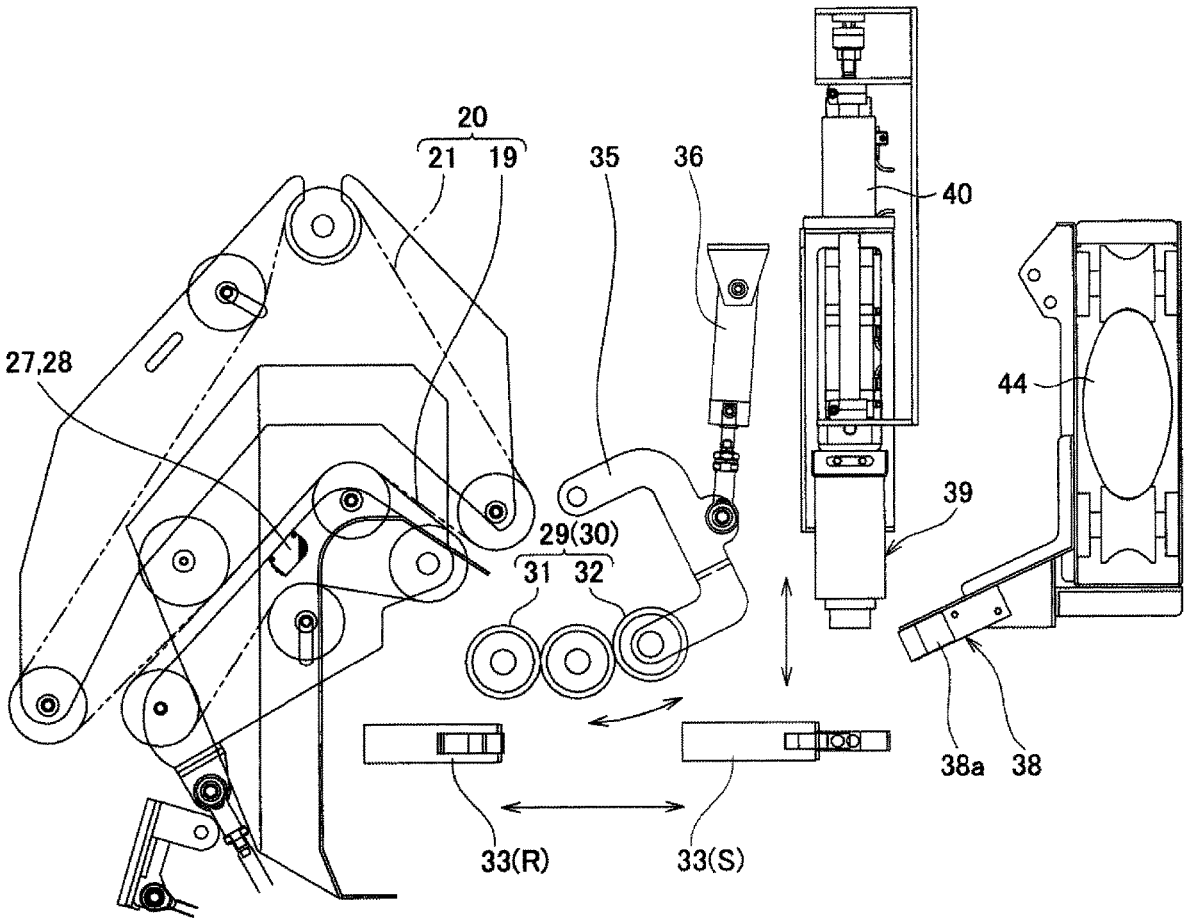
FIG. 6 is an enlarged side view illustrating main parts from the feeding conveyor to an unfolding member, and particularly, illustrating the positional relationship between a spreading clamp and lifting means.

In this embodiment, the pair of rollers 32 of the catch means 29 are attached to one end of a crank 35, and a crank 35 is journalled by a supporting shaft 35*a* on a feeder body side at the other end of the crank, and is operated by a drive part 36 including, for example, a direct-acting cylinder connected to an intermediate portion of the crank 35, refer to FIG. 6. The catch means 29 having the above catch member 33 constitutes a keeping-transferring part 30 that moves the cloth to a keeping-transferring member 41 while holding the cloth on the left and right trailing ends together with unfolding members 37 and 38 to be described below.

In FIG. 5, the catch member 33 is one of the constituent elements of the catch means 29, and holds the left and right trailing ends of the cloth. The left and right trailing ends of the held cloth is in the state of extending upward from below the pair of rollers 31 and 32, and the catch member 33 holds a lower portion of the cloth near the leading end as well. The catch member 33 is provided so as to be movable in the movement direction of the cloth, and is provided to correspond to each of the catch means 29. The movement range of the catch member 33, as illustrated by a solid line in FIG. 6, is between a reception position R where the left and right trailing ends of the cloth is received from the catch means 29 and a keeping-transferring position S where the left and right trailing ends is kept and transferred to the pair of unfolding members 37 and 38.

Since the unfolding members 37 and 38 hold the left and right trailing ends Wl and Wr of the cloth, the above-mentioned unfolding members 37 and 38 are provided using one pair as one set. That is, in order to perform the work of keeping and transferring the cloth conveyed by the feeding conveyor 20, a set of the pair of unfolding members 37 and 38 is provided on both the left and the right sides toward the front surface of the feeder (refer to FIGS. 1 and 5). Each of the unfolding members 37 and 38 has holding pieces 37*a* and 37*b* or 38*a* and 38*b* that are directed from the front (downstream side) in the movement direction for conveyance of the cloth to the rear, upstream side, respectively, and are opened and closed substantially to the right and the left as seen from the top or from the front.

Therefore, although each of the unfolding members 37 and 38 approaches lifting means 39, 39*l*, 39*r*, in an open state, the unfolding members are in a positional relationship in which the unfolding members do not come into contact with each other, FIGS. 5 and 6. The holding pieces 37*a*, 37*b*, 38*a*, and 38*b* are openable and closeable by arbitrary drive parts provided in the unfolding members 37 and 38, and are configured so as to be rotated toward the lifting means 39, 39*l*, 39*r*, and brought into a closed state to hold the left and right trailing ends Wl and Wr of the cloth. In addition, the left and right trailing ends Wl and Wr of the cloth are trailing ends in a state where they are caught by the catch means 29. However, since the leading and trailing positions of the cloth W are also converted by the left and right trailing end portions being shifted and unfolded by the unfolding members 37 and 38, the left and right trailing ends until then become leading portions of the cloth W after the unfolding and are conveyed to the following process.

The lifting means 39, 39*l*, 39*r*, is arranged at the above keeping-transferring position S. Although the lifting means 39 in the embodiment includes a pair of left and right means and uses a suction force, the lifting means is not limited to using the suction force. For example, a well-known pick-up method can also be applied without a technical problem. The lifting means 39 sucks the left and right trailing ends of the cloth and lifts the left and right trailing ends at positions higher than the unfolding members 37 and 38 when the catch member 33 has traveled and moved to the keeping-transferring position S from the reception position R. The lifting means 39 temporarily holds the above left and right trailing ends Wl and Wr, which extend upward from the catch means 29, with a suction force, the holding of the left and right trailing ends by the unfolding members 37 and 38 is performed in that time, and the lifting means is provided so as to be movable upward and downward in order to shift the left and right trailing ends. 40 represents a drive part for the upward-downward movement, and well-known drive devices, such as the aforementioned direct-acting cylinder, are used also for this drive part.

The unfolding members 37 and 38 can travel in a leftward-rightward direction by a guide rail 44 installed at an upper rear portion of the feeder body. Reference numeral 41 in FIG. 2 represents a movable keeping-transferring member. This movable keeping-transferring member is provided so as to be movable in a conveying direction of the cloth by a driving mechanism (not illustrated) in order to receive a leading end of the cloth placed on an upper surface of the catch member 33 at the keeping-transferring position S of the catch member 33 and deliver the leading end of the cloth to a conveying conveyor 42 on the downstream side. Since the unfolding members 37 and 38 pull the cloth held by the keeping-transferring part 30 to the right and the left and bring the cloth into a shaped state, it can be said that the unfolding members constitute a shaping part 45. The above shaping parts 45 are arranged in two left and right places in a subsequent stage of the feeding conveyor 20, and constitute the cloth standby part 14. In addition, reference numeral 43 represents a suction box, and this suction box shapes the fed cloth into its original shape while sucking the cloth. 46 represents a spreading belt, and this spreading belt spreads the cloth in a leftward-rightward direction in contact with the cloth.

In the apparatus of the invention having such a configuration, a worker can attach the cloth W to three clamps 12 in a state where the leading cloth W is unfolded by the unfolding members 37 and 38, refer to FIG. 1. In the feeder of the invention, the portion of the cloth W attached between the pair of clamps 12 and 12 is formed into a linear shape. The cloth W is conveyed while being placed in substantially central portions in that state, and both the left and the right side portions that hang down to the left and right of the feeding conveyor 20 are brought closer to the central portions by the guide members 23 and 24, and are narrowed. As a result, the left and right trailing ends Wl and Wr of the cloth, refer to FIG. 8A, finally pass through the sensors, and are detected, and are simultaneously held by the catch means 29. Moreover, the lifting means 39 moves downward and approaches and sucks the left and right trailing ends Wl and Wr of the cloth W, thereby lifting the cloth positions higher than the unfolding members 37 and 38.

Figure 10:
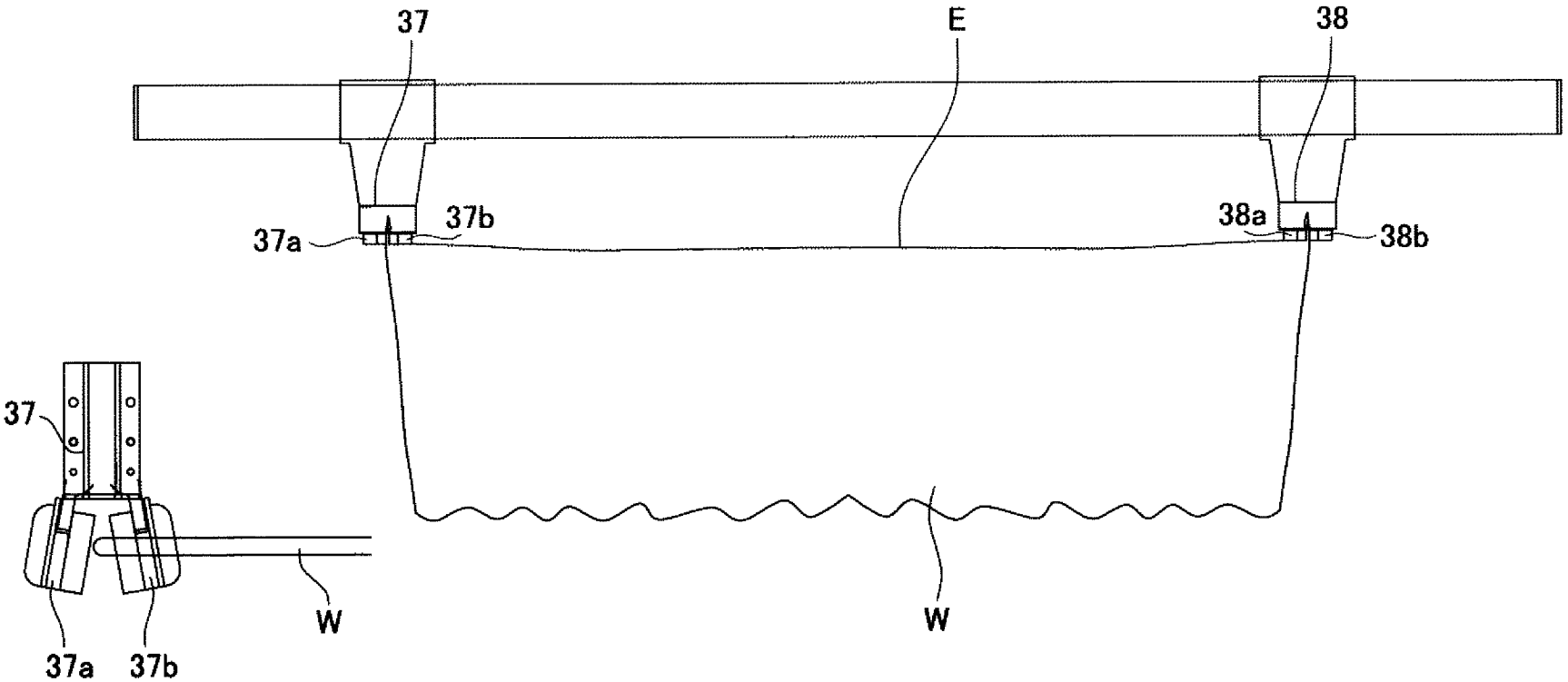
FIG. 10 is a front view illustrating a cloth holding direction using the unfolding member.

Then, the unfolding members 37 and 38 approach and hold the left and right trailing ends Wl and Wr of the cloth, above the catch member 33 at the keeping-transferring position S. A first transfer stage of the cloth W is completed by this, refer to FIG. 8B. Therefore, the trailing ends Wl and Wr of the cloth may be changed to the leading ends of the cloth after this. Thereafter, the unfolding members 37 and 38 holding the left and right trailing ends Wl and Wr of the cloth W unfold the cloth to the right and the left while traveling and moving to a central portion of the feeder body. That is, the leading and tailing end positions of the cloth W are converted, and a side portion E maintains a linear shape, refer to FIG. 10, becomes a leading end side, and is conveyed to the following process. If the cloth is fed at a general worker's work speed as described above, feeding work in the subsequent stage proceeds without stagnating.

In automatic feeders in the related art, the amount of supply of the cloth is dependent only on the worker's work speed, and it is impossible that the above work speed exceeds a feeding speed obtained by the automatic feeder. However, according to the invention, a piece of the cloth W undergoes the above feeding processing and is fed into a process in one of the three clamps 12, and the cloth W is not directly placed on the feeding conveyor but the cloth first goes via the moving mechanism 13. Thus, this functions as the cloth standby part 14 in the preceding stage of the feeding conveyor 20. While the first cloth W is in the feeding process as described above, two pieces of the cloth W are in a standby state in conformity with the remaining two clamps 12, respectively. Thus, these two pieces of the cloth W are in a buffering state, and the number of pieces of the cloth that is accumulated while being conveyed in the process with a given margin can be adjusted.

Figure 8B:
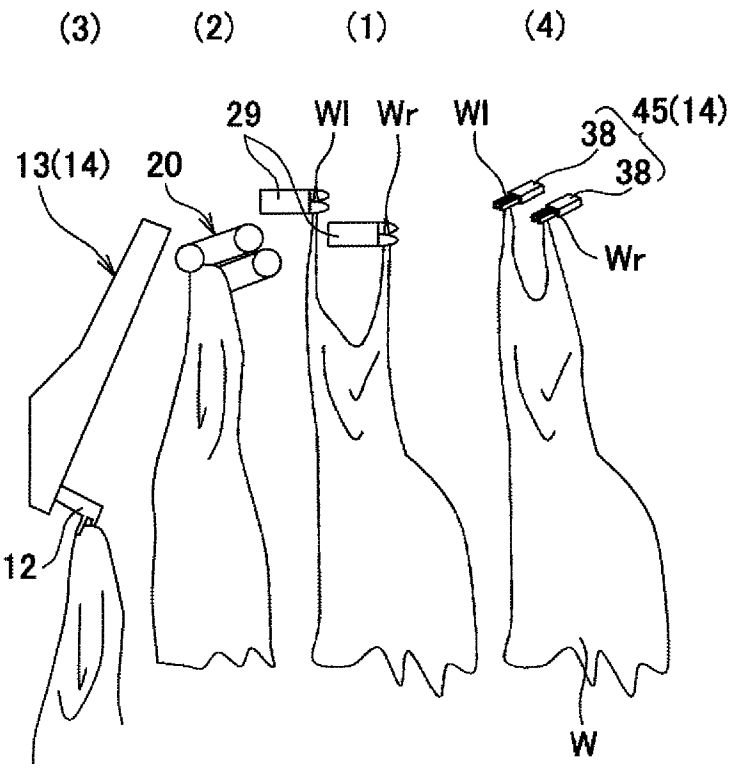
FIGS. 8A and 8B are explanatory views illustrating processes according to the invention.
Figure 8A:
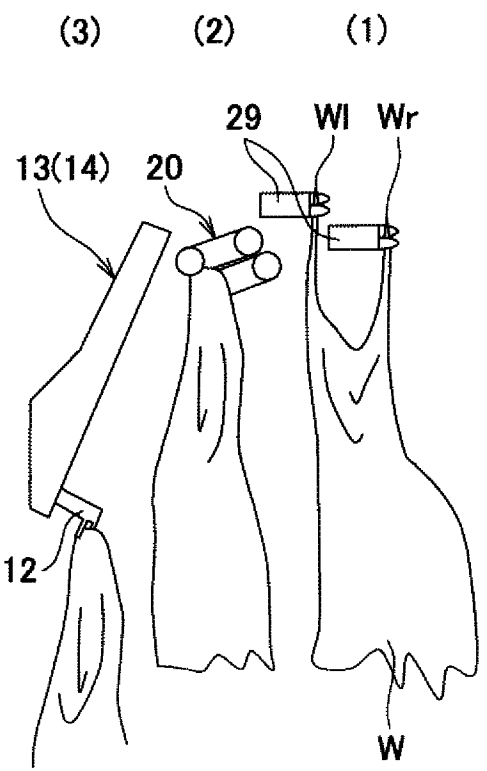
Figure 8C:
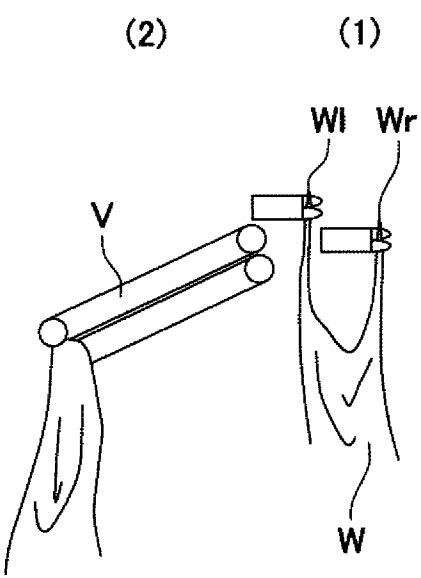
FIG. 8C is an explanatory view illustrating a process according to a related-art device.

FIGS. 8B and 8C illustrates a state where the left and right trailing ends Wl and Wr of the clothing W have been held by the catch means 29 or the like in this way. FIG. 8A illustrates a state where the cloth W undergoes three processes including a process in which the cloth W is held by the clamps 12, a process in which the detection of the left and right trailing ends is performed during conveyance using the feeding conveyor 20, and a process in which the left and right trailing ends are held by the catch means 29, in the apparatus of the invention. When this is compared with a related-art process of FIG. 8C, it can be seen that the temporary standby time or timing of the cloth W can be saved by the process in which the cloth W is held by the clamps 12 that are the cloth standby part in the preceding stage of the feeding conveyor 20. Additionally, it is also understood that the feeding conveyor 20 can be made shorter than a related-art long conveyor V.

FIG. 8B illustrates a buffering state in the apparatus of the invention where a cloth unfolding process performed by the shaping part 45 including the unfolding members 37 and 38 has been added to FIG. 8A. Since a shaping process using the shaping part 45 is added in FIG. 8B, the cloth undergoes twice the number of processes in the related art in the comparison with the simple numbers of processes. Moreover, it can be seen that a pair of left and right shaping parts 45 are arranged with respect to one keeping-transferring part 30, and the temporary standby time or timing of the cloth can be further saved. In FIG. 8, (1) represents transfer, (2) represents the feeding conveyor, (3) represents the clamps, and (4) represents the unfolding members.

Figure 9:
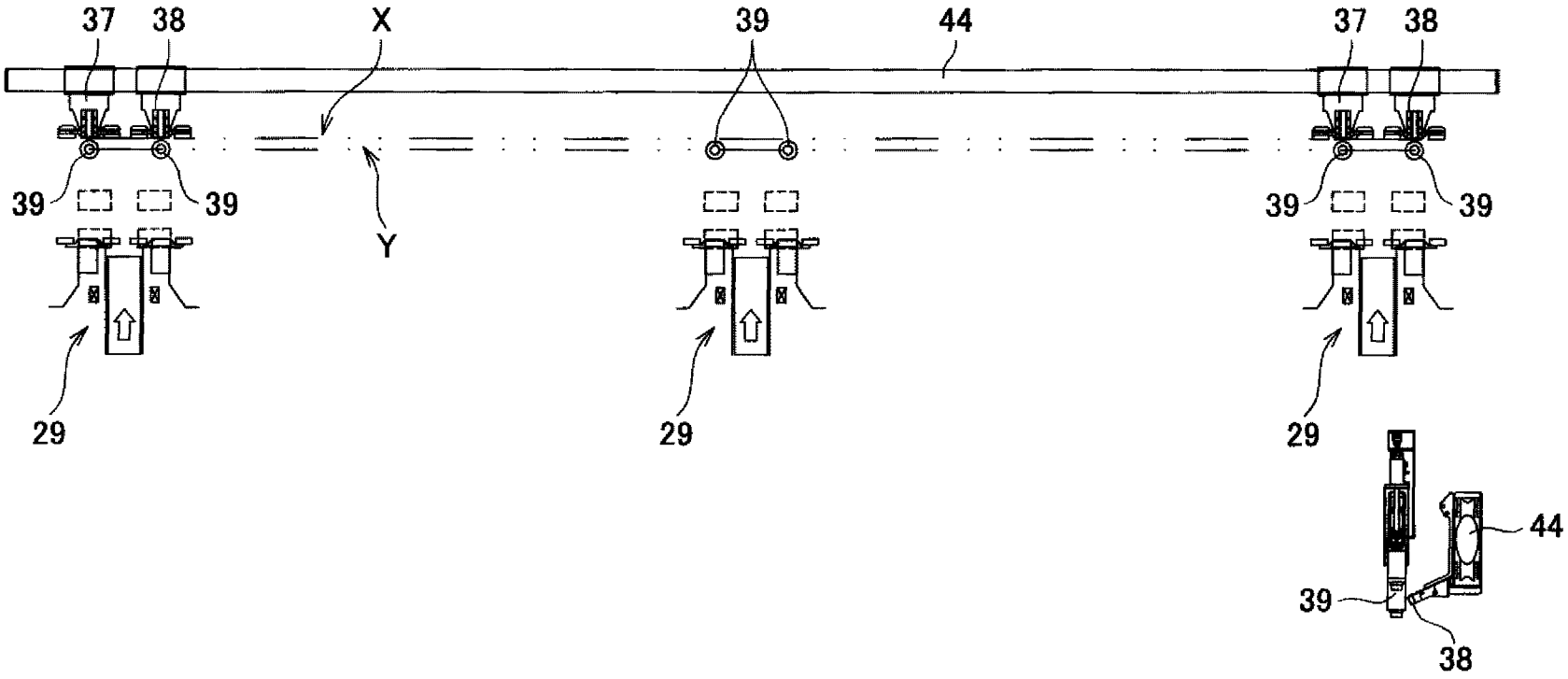
FIG. 9 is a front view illustrating the positional relationship between the unfolding member and the lifting means according to the invention.

In the automatic cloth feeder 10 to which the buffering device related to the invention, as described with reference to FIGS. 5 and 6, each of the unfolding members 37 and 38 approaches the lifting means 39, 39*l*, 39*r*, in the open state. However, the unfolding members are in a positional relationship of not coming into contact with each other, refer to FIG. 9. That is, a traveling track X of the unfolding members 37 and 38 does not interfere with a line Y that connects the lifting means 39. Therefore, each of the unfolding members 37 and 38 can travel at any time without worrying about the interference with the lifting means 39 unlike the related art, improvement in the work speed is possible, and the adjustment of the supply speed of the cloth W is facilitated in the relationship with the buffering.

Additionally, the automatic cloth feeder 10 related to the invention, as described with FIG. 5 and FIG. 6, has a configuration in which each of the unfolding members 37 and 38 has the holding pieces 37*a* and 37*b* or 38*a* and 38*b* that are directed from the front in the movement direction for conveyance of the cloth to the rear and are opened and closed substantially to the right and the left as seen from the top or from the front. For this reason, when the cloth W is unfolded to the right and the left by the unfolding members 37 and 38, and the unfolding direction of the cloth and the holding direction of the holding pieces 37*a*, 37*b*, 38*a*, and 38*b* are substantially orthogonal to each other, refer to FIG. 10. Therefore, since external forces that act on the holding pieces 37*a*, 37*b*, 38*a*, and 38*b* when the cloth W is unfolded are substantially orthogonal to the holding direction, the possibility that the cloth may slip out becomes remarkably smaller than a system in which the external forces and the holding direction are parallel to each other.

Figure 11C:
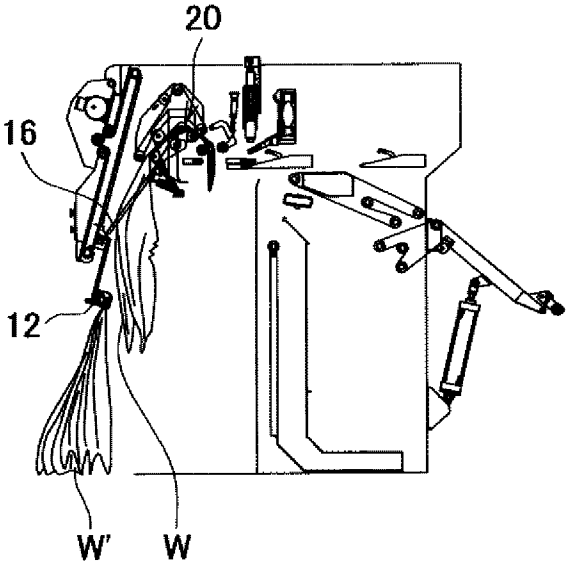
FIG. 11 consists of FIGS. 11A, 11B and 11C and are views illustrating cloth separating processes A, F, and C using a trailing end separating member.
Figure 11B:
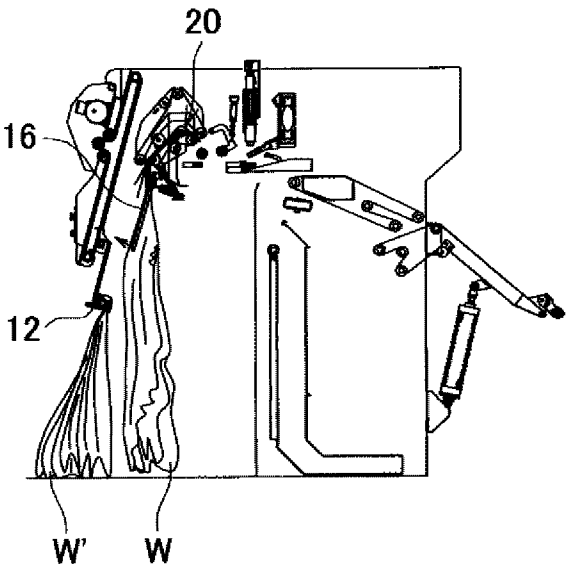
Figure 11A:
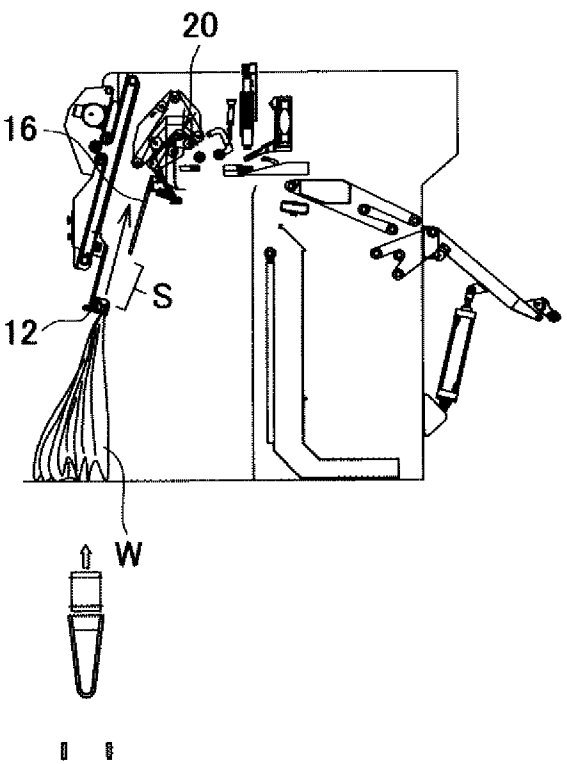

In the automatic cloth feeder 10 related to the invention, it is also easy to deal with various types of long and short cloth W, using the trailing end separating mechanism 15 for the cloth. In the case of the cloth W of long meshes, in a related-art trailing end guiding system, trailing ends of the cloth may be caught and interrupted, and the cloth W cannot be continuously attached to the clamps 12. However, the invention has the trailing end separating mechanism 15 for the cloth. Thus, a space S according to the length of the clamp attachment 12*b* or the trailing end separating member 16 is provided between the tip of the trailing end separating member 16 and the clamps 12, FIG. 11A. Therefore, if preceding cloth W is conveyed by the feeding conveyor 20, the cloth W can hang down to the space S, and the following cloth W' can be immediately attached to the clamps 12, FIG. 11B.

The automatic cloth feeder 10 related to the invention has the above trailing end separating mechanism 15, and the trailing end separating member 16 is made rotatable toward the clamp attachment 12*a*. By rotating the trailing end separating member 16 from an inclined posture in which the trailing end separating member is parallel to the clamp movement direction to an inclined posture near the clamp attachment during cloth conveyance, a change occurs in the posture of the cloth W, FIG. 11C. That is, the trailing end separating member 16 is located in the middle of the pair of left and right clamps 12 and 12, and is rotated from a posture with a steep inclination to a posture with a gentle inclination at that position. Therefore, the cloth W flaps at the central portion by such movement of the trailing end separating member 16. As a result, an action that separates the trailing end of the cloth W to left and right is promoted.

REFERENCE SIGNS LIST

10: AUTOMATIC CLOTH FEEDER
11: CLOTH SUPPLY PART
12: CLAMP
13: MOVING MECHANISM
14: CLOTH STANDBY PART
15: TRAILING END SEPARATING MECHANISM
16: TRAILING END SEPARATING MEMBER
17, 22, 34, 36, 40: DRIVE PART
18: FEED GUIDE PART
19: LOWER CONVEYOR
20: FEEDING CONVEYOR
21: UPPER CONVEYOR
23, 24: GUIDE MEMBER
25, 26: NARROWED PASSAGE
27, 28: SENSOR
30: KEEPING-TRANSFERRING PART
31, 32: PAIR OF ROLLERS
33: CATCH MEMBER
37, 38: UNFOLDING MEMBER
39: LIFTING MEANS
41: KEEPING-TRANSFERRING MEMBER
42: CONVEYING CONVEYOR
44: GUIDE RAIL
45: SHAPING PART

The invention claimed is:

1. An automatic cloth feeder that conveys cloth with a feeding conveyor, detects a trailing end of the cloth to hold the trailing end with a keeping-transferring part in the process of conveyance, and feeds the trailing end of the cloth into a process as a leading end, wherein the keeping-transferring put has a pair of unfolding members provided as one set are provided on an outlet side of the feeding conveyor in order to hold the left and right trailing ends of the cloth, and wherein the keeping-transferring part has holding pieces that are opened and closed substantially to the right and the left as seen from the top or from the front, is in a positional relationship of approaching lifting means but not coming into contact with the lifting means in an open state, and is configured so as to hold the trailing ends of the cloth located at the position of the lifting means in a closed state.

2. The automatic cloth feeder according to claim 1 that conveys cloth with a feeding conveyor, detects a trailing end of the cloth to hold the trailing end with a keeping-transferring part in the process of conveyance, and feeds the trailing end of the cloth into a process as a leading end, the automatic cloth feeder comprising:

a trailing end separating member that extends with a given length substantially parallel to a movement direction of a clamp and has a space between a tip thereof and the clamp, and wherein the trailing end separating member is configured so as to operate to flap the cloth that hangs down from a feed port of the feeding conveyor.

3. The automatic cloth feeder according to claim 1, wherein the feeding conveyor includes a lower conveyor and an upper conveyor, is high at an intermediate portion and falls on an inlet side and an outlet side, is formed in a gentle chevron shape as a whole, and is thereby designed so as to convey cloth naturally, and wherein the delivery port of the feeding conveyor is directed to between a pair of rollers and a feed guide part is arranged in the same direction in the lower conveyor.

4. An automatic cloth feeder that conveys cloth with a feeding conveyor, detects a trailing end of the cloth to hold the trailing end with a keeping-transferring pair during the process of conveyance, and has a buffering function of causing the cloth to stand by temporarily when the trailing end of the cloth is fed into a process as a leading end, wherein the keeping-transferring part having a pair of unfolding members provided as one set are provided on an outlet side of the feeding conveyor in order to hold the left and right trailing ends of the cloth, wherein the keeping-transferring part has holding pieces that are opened and closed substantially to the right and the left as seen from the top or from the front, and is in a positional relationship of approaching lifting means but not coming into contact with the lifting means in an open state and of holding the trailing ends of the cloth located at the position of the lifting means in a closed state, and wherein a traveling track X of the unfolding members does not interfere with a line Y that connects the lifting means, thereby providing a buffering function of enabling the unfolding members to travel and move at any time.

* * * * *